US007893797B2

(12) United States Patent
Eckert et al.

(10) Patent No.: US 7,893,797 B2
(45) Date of Patent: Feb. 22, 2011

(54) LINE CIRCUIT BREAKER AND MAGNET YOKE FOR A LINE CIRCUIT BREAKER

(75) Inventors: Gunther Eckert, Maxhütte-Haidhof (DE); Winfried Vierling, Neutraubling (DE); Christoph Weber, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/304,798

(22) PCT Filed: May 21, 2007

(86) PCT No.: PCT/EP2007/054861

§ 371 (c)(1),
(2), (4) Date: Oct. 5, 2009

(87) PCT Pub. No.: WO2007/144246

PCT Pub. Date: Dec. 21, 2007

(65) Prior Publication Data

US 2010/0052828 A1 Mar. 4, 2010

(30) Foreign Application Priority Data

Jun. 16, 2006 (DE) ..... 10 2006 027 812

(51) Int. Cl.
*H01H 71/40* (2006.01)

(52) U.S. Cl. ..... 335/35; 335/6; 335/37

(58) Field of Classification Search ..... 335/6, 335/35–45

See application file for complete search history.

(56) References Cited

U.S. PATENT DOCUMENTS

| | | | | |
|---|---|---|---|---|
| 3,088,008 | A * | 4/1963 | Gelzheiser | 335/44 |
| 3,110,786 | A | 11/1963 | Gelzheiser | 200/88 |
| 3,818,168 | A * | 6/1974 | Norden | 200/401 |
| 3,950,714 | A | 4/1976 | Mrenna et al. | 335/35 |
| 4,386,329 | A * | 5/1983 | Norden | 335/35 |

(Continued)

FOREIGN PATENT DOCUMENTS

| | | |
|---|---|---|
| DE | 2006872 | 2/1970 |

(Continued)

OTHER PUBLICATIONS

International Search Report; PCT/EP2007/054861; pp. 3, May 21, 2007.

(Continued)

*Primary Examiner*—Ramon M Barrera
(74) *Attorney, Agent, or Firm*—King & Spalding L.L.P.

(57) ABSTRACT

In line circuit breakers with a combined overcurrent/short-circuit current tripping device, tripping should take place in a well defined manner in the case of an overcurrent and in the case of a short-circuit current. For this purpose, gaps (A, B) need to be set precisely. If the housing is made from a cost-effective housing material such as thermosetting plastic it is subject to shrinkage. As a result, the mentioned gaps may change. An armature (24) is mounted in such a way that it changes its rest rotary position in the event of shrinkage of the housing. A magnet yoke (28) as part of the overcurrent/short-circuit current tripping device is mounted and shaped in such a way that the rotation is compensated for precisely, so that the mentioned gaps do not change despite the shrinkage.

11 Claims, 3 Drawing Sheets

U.S. PATENT DOCUMENTS

| | | | | |
|---|---|---|---|---|
| 7,135,953 | B2 * | 11/2006 | Leitl et al. | 337/84 |
| 2004/0100350 | A1 | 5/2004 | Weber | 337/36 |
| 2004/0140881 | A1 | 7/2004 | Leitl et al. | 337/57 |

FOREIGN PATENT DOCUMENTS

| | | |
|---|---|---|
| RU | 2117357 C1 | 8/1998 |
| WO | 02061785 | 8/2002 |
| WO | 03005395 | 1/2003 |

OTHER PUBLICATIONS

Russian Office Action, Russian application No. 2009101165, 13 pages, Apr. 27, 2010.

* cited by examiner

LINE CIRCUIT BREAKER AND MAGNET YOKE FOR A LINE CIRCUIT BREAKER

CROSS-REFERENCE TO RELATED APPLICATIONS

This application is a U.S. National Stage Application of International Application No. PCT/EP2007/054861 filed May 21, 2007, which designates the United States of America, and claims priority to German Application No. 10 2006 027 812.7 filed Jun. 16, 2006, the contents of which are hereby incorporated by reference in their entirety.

TECHNICAL FIELD

The invention relates to a line circuit breaker and a magnet yoke for a line circuit breaker.

BACKGROUND

The line circuit breaker has a housing. A switching device with a switch that can switch on and off and a combined overcurrent short-circuit current tripping device are arranged in the housing. Such a combined overcurrent short-circuit current tripping device was developed in order to use the smallest possible components. It includes on the one hand an armature and on the other hand a magnet yoke, to which a bimetallic element is fastened, through which current flows when the switch is switched on. A field line outlet plate is also arranged on the magnet yoke, on which field line outlet plate magnetic field lines outgoing from the magnet yoke during current flow and guided by the magnet yoke appear. The bimetallic element is arranged on a first side of the armature. In the uninterrupted system, it deforms in the case of an overcurrent and presses on the armature. The field line outlet plate is arranged on an opposite second side of the armature. In the case of a short-circuit current, it magnetically attracts the armature. The armature is thus rotated out of a rotational position at rest in the same predetermined direction both with an overcurrent and also with a short circuit current. With one rotation, it can cause the switch to switch off, for instance by way of a ratchet mechanism.

Cost-effective housing materials, like duroplasts (inter alia aminoplasts) for instance, are subject to a housing shrinkage during the course of the service life of the device. This is problematical because many components are to be mounted on the housing. The housing shrinkage results in the gaps between the components changing in respect of one another. This may have a negative influence on the thermal tripping (overcurrent tripping) and the magnetic tripping (short circuit current tripping).

The problem was previously regularly solved in that the whole switching mechanism was mounted in metal, so that the housing shrinkage could have no influence on the tripping. These constructions are very expensive.

Alternatively, low-shrink or shrink-free housing masses, for instance melamine masses, were used. This solution is also more expensive than the use of shrinkage-prone duoplast masses.

SUMMARY

According to various embodiments, a cost-effective construction can be provided in which it is nevertheless ensured that the thermal and magnetic tripping takes place in a reliable fashion.

According to an embodiment, a magnet yoke for a line circuit breaker, on which a conductive bimetallic element is arranged may comprises a base body, which is designed to guide magnet field lines emerging from the bimetallic element during the current flow to a field line outlet plate, by the surface normal of which a first direction is defined and with mounting sections being defined on two opposite sides of the magnet yoke, with which the magnet yoke can be supported in a housing and which allows the introduction of forces from the housing into the magnet yoke in a second and third direction at a predetermined angle to the first direction in each instance, wherein a deformable element is arranged between one of the two mounting sections and the base body, which element deforms with the introduction of forces acting in the second and third direction and as a result allows a movement of the field line outlet plate in a direction, which essentially corresponds to the first direction.

According to a further embodiment, the elastic element can be rod-shaped and may have two points with a reduced cross-section which are used as desired flexion points. According to a further embodiment, the rod-shaped elastic element may extend linearly at an angle of 35° to 55° in respect of the first direction on the one hand and in respect of the second direction on the other hand from a mounting section to the base body. According to a further embodiment, one of the two mounting sections can be arranged between the base body and the elastic element, is embodied as a T-shaped foot, which allows the engagement of a screw on a limb for defining a position of the foot and thus of the magnet yoke and allows an abutment on another limb in order to hold the foot in the case of different positions of the screw. According to a further embodiment, the magnet yoke can be embodied as a stamped bending part.

According to another embodiment, a line circuit breaker, may comprise a housing, in which a switching device with a switch that can be switched on and off and a combined overcurrent short circuit current tripping device are arranged, with the overcurrent short circuit current tripping device on the one hand including an armature and on the other hand including a magnet yoke, on which a bimetallic element is fastened, by means of which current flows when the switch is switched on, with a field line outlet plate being arranged on the magnet yoke, on which field line outlet plate magnetic field lines emerging from the bimetallic element during current flow and guided by the magnet yoke appear, with the bimetallic element being arranged on one side of the armature in order to press against the armature during overcurrent and also with the field line outlet plate being arranged on an opposite side of the armature in order to magnetically attract the armature during short circuit current so that both during overcurrent and during short circuit current the armature is rotated out of a rotational position at rest in the same predetermined direction, with the rotation potentially causing the switch to be switched off, wherein the housing is subject to shrinkage and the armature is mounted such that during the housing shrinkage, its rotational position at rest changes and the magnet yoke is mounted such that it likewise receives forces during a housing shrinkage and that the magnet yoke is molded such that the received forces effect a change in the position of the bimetallic element and the field line outlet plate such that the change in the rotational position at rest of the armature is counteracted and this is preferably balanced out.

According to a further embodiment, the magnet yoke can be a magnet yoke as described above.

BRIEF DESCRIPTION OF THE DRAWINGS

An embodiment of the invention is then described with reference to the drawing, in which.

DETAILED DESCRIPTION

Figure 1:
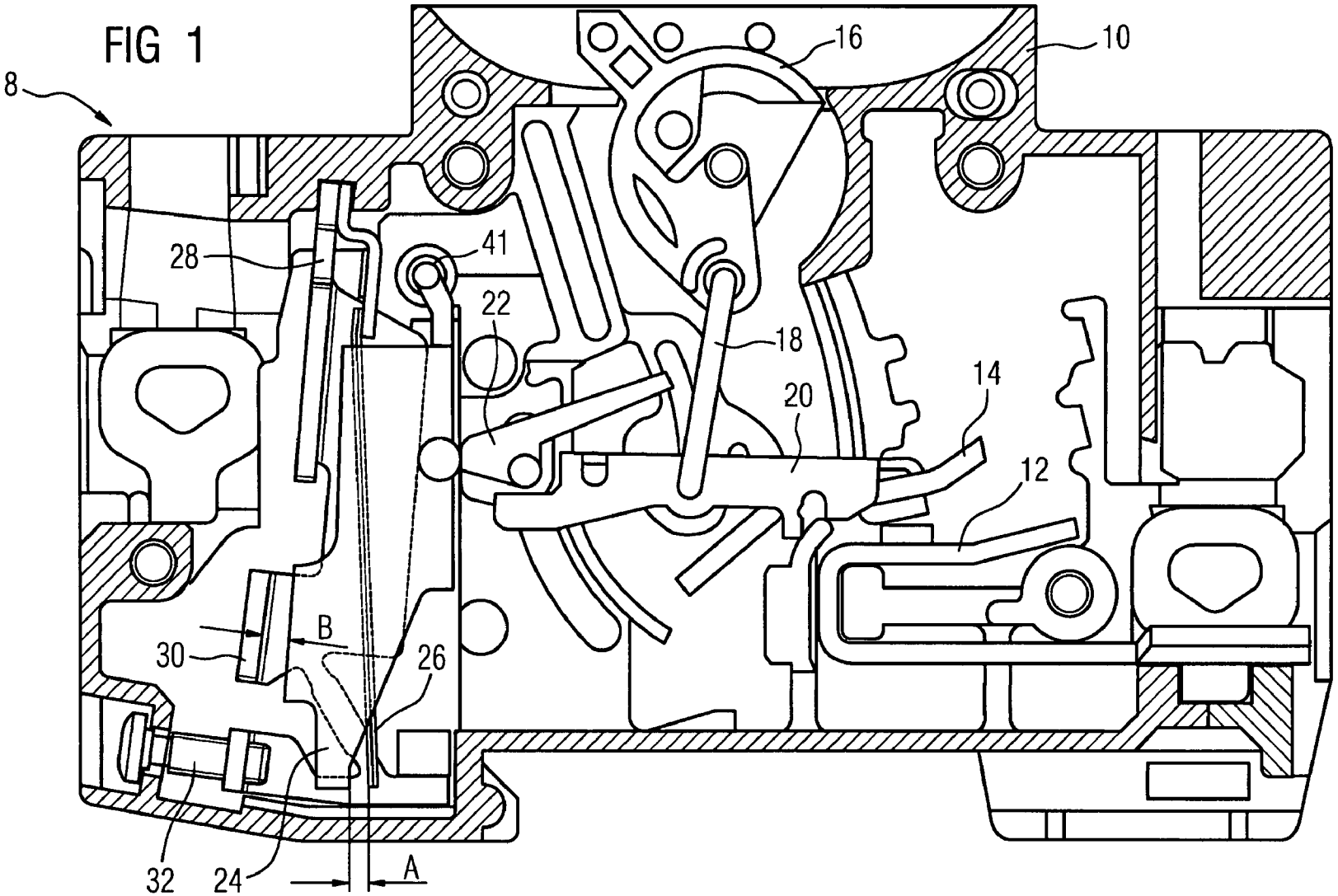
FIG. 1 shows a schematic cross-sectional view through an line circuit breaker according to an embodiment.

A housing is thus used in accordance with various embodiments which is subject to shrinkage and mounts the armature such that it changes its rotational position at rest in the case of a housing shrinkage. The magnet yoke is mounted such that it likewise absorbs forces in the case of a housing shrinkage. It is molded such that the absorbed forces effect a change in the position of the bimetallic element and the field line outlet plate such that the change in the rotational position at rest of the armature is compensated for. This change (complete, as far as is possible with a rotation) is preferably compensated for.

The troublesome shrinkage is thus not intentionally uncoupled from the armature, but instead the shrinkage is also exploited on the part of the magnet yoke such that the shrink effect on the armature and the shrink effect on the magnet yoke act in a precisely opposite fashion.

A magnet yoke according to an embodiment can be preferably used in the case of the line circuit breaker. Such a magnet yoke for a line circuit breaker has the property of a conductive bimetallic element being fastenable thereto. It has a base body, which is designed to guide magnetic field lines emanating from a bimetallic element fastened to the magnet yoke during current flow to a flat field line outlet plate, through the surface normal of which a first direction is defined. Mounting sections are defined on two sides of the magnet yoke which are arranged opposite to one another, with which the magnet yoke can be mounted in a housing. The mounting sections also allow the introduction of forces from the housing into the magnet yoke in a second and third direction (which are generally essentially opposite to one another). These directions are essentially perpendicular to the first direction, namely by definition at an angle of 75° to 105° (preferably 85° to 95°, particularly preferably 90°) in respect of the first direction.

The magnet yoke according to an embodiment is characterized in that an elastic element is arranged between one of the two mounting sections and the base body, said elastic element bending in the case of the introduction of forces acting in the second and third direction and as a result enabling a movement of the field line outlet plate in one direction, which is essentially identical to the first direction. By definition, it deviates by at most 20° (preferably by at most 10°) from this direction (with it being possible for this deviation to be arbitrary as viewed from the deviation direction).

In simple terms, it is possible to say that the magnet yoke receives forces in one dimension and converts said forces in one movement into one dimension which is perpendicular hereto.

To this end, the elastic element is preferably embodied in the manner of a rod and has two rod points with (by comparison with the remaining rod shape) a reduced cross-section, which are used as desired flexion points. The prespecification of the desired flexion points allows the type of bending to be defined in a particularly clear fashion, so that the movement of the field line outlet plate can take place in a well-defined fashion and the object can be achieved of very precisely counteracting the change in the rotational position of the armature at rest.

With a preferred embodiment, the rod-shaped elastic element extends linearly at an angle of 35° to 55° (preferably of 45°) in respect of the first direction on the one hand and in respect of the second direction on the other hand from a mounting section to the base body. In other words, the rod-shaped elastic element runs "diagonally". As a result, the acting forces are conveyed in an optimum fashion.

One of the two mounting sections, between which and the base body the elastic element is arranged, is preferably embodied as a T-shaped foot. The foot allows the engagement of a screw on a first limb in order to define a position of the foot and thus of the magnet yoke and on another (opposite) limb an abutment to stop the foot when the screw is in different positions.

With a further preferred embodiment, the magnet yoke is embodied as a stamped bending part. It can as a result be produced in a particularly cost-effective fashion.

A line circuit breaker shown in FIG. 1 and designated as a whole by the number 8 has a housing 10, which consists of a material like a duroplast for instance, which is subject to a housing shrinkage. The actual switching device includes a fixed contact 12 and a moving contact which can be pivoted onto the fixed contact 12. The moving contact 14 is moved into the switching-on position shown in FIG. 1 with the aid of a handle 16, with the handle 16 moving the moving contact 14 by way of a bracket 18 and a contact support 20.

Figure 2:
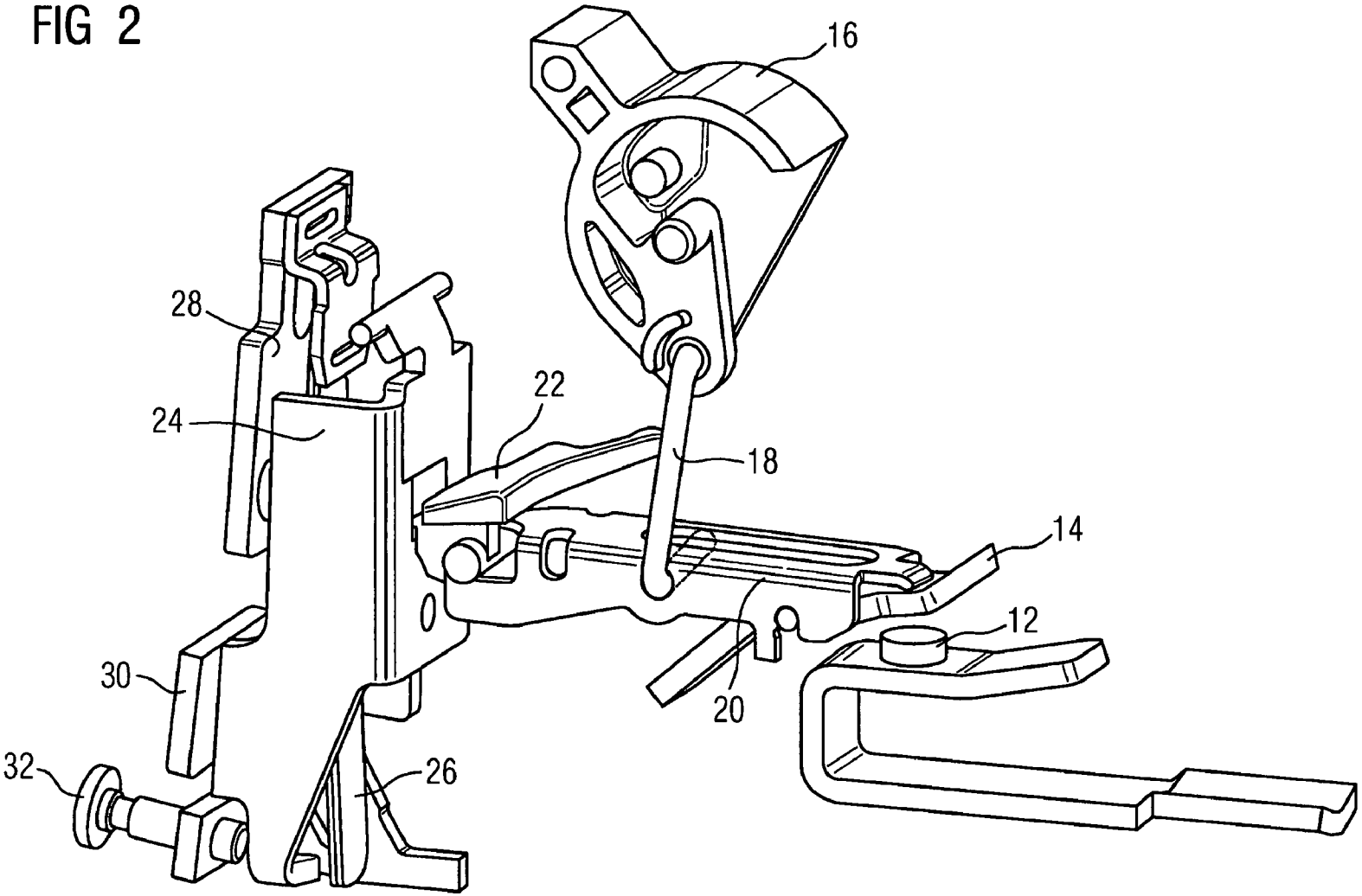
FIG. 2 shows a perspective representation of the most important switching elements of the line circuit breaker in FIG. 1.

A catch 22 engages with the contact support 20, said catch 22 engaging in an armature 24 in the basic state, i.e. if the switched-on state is to be maintained, see in particular the representation in FIG. 2. If the armature 24 pivots in the clockwise direction, the catch 22 disengages and this effects, by way of the contact support 20, a release of the moving contact 14 from the fixed contact 12 and thus an interruption in the switched-on state.

Such a rotation of the armature 24 can be introduced in two different ways. A bimetallic element 26 is first provided, which is fastened to a magnet yoke 28. The fastening can be seen particularly well in FIG. 4. In the rest state, the bimetallic element 26 is to have a gap A from the armature 24. Current passes through the bimetallic element when in the switched-on state. With overcurrents, the bimetallic element heats up and thereby bends. The bimetallic element 26 bends here in respect of armature 24, overcomes the gap A and finally presses on the armature 24, so that this moves in the clockwise direction. This is thus a mechanism for overcurrent tripping. At the same time, a tripping can occur with the aid of the magnet yoke 28 also in the case of short circuit currents. To this end, a field line outlet plate 30 is embodied on the magnet yoke 28, namely on precisely the other side of the armature 24 in comparison with bimetallic element 26, in FIG. 1, in other words to the left of the armature 24 instead of like the bimetallic element 26 to the right of the armature 24. In the base position, a gap B is defined between the field line outlet plate 30 and the armature 24. In the case of a short circuit current a significantly increased current flows through the bimetallic element 26. The magnet yoke 28 guides the magnet field lines, which emerge from the bimetallic element 26 through which the current is flowing to the field line outlet plate 30, so that a magnetic attraction force is exerted by the field line outlet plate 30 on the armature 24 and attracts this. It then rotates in the clockwise direction. This is thus a short circuit tripping mechanism in addition to the thermal tripping mechanism. While with a thermal tripping mechanism, the bimetallic element 26 overcomes the gap A and presses on the armature 24, in the case of the short circuit the magnet yoke 28 attracts the armature 24 from the opposite side so that the gap 24 is overcome and precisely effects a rotation of the same in the clockwise direction. The catch 22 then disengages and the electrical contact between the moving contact 14 and the fixed contact 12 is released, which also interrupts the current.

With both types of tripping, it depends on the respective gap A and/or B being set precisely, so that the tripping is well-defined. A locking screw 32, which engages in a T-shaped foot 34 of the magnet yoke 28, in more precise terms in a limb 36 of the foot 34, is used to adjust the gaps A and B. The magnet yoke is mounted and held in a recess 40 in the housing the opposite limb 38. The position of the screw 32 is defined. With a rotation of the screw 32, the position of the screw thus does not change, instead that of the magnet yoke 28, into which the screw 32 engages. Accordingly, the gap A can be reduced and increased and at the same time the gap B can be enlarged and/or reduced in size.

The shrinkage of the housing 10 after a longer housing service life can now lead to the gaps A and B changing so that the tripping no longer takes place in a well-defined manner. The construction, as shown in the FIG, causes the shrinkage to have opposing effects. The armature 24 is mounted in a bearing 41 on the housing 10. With a shrinkage of the housing 10, the armature rotates in the clockwise direction, however not so far that the catch 22 is tripped. In this way the gap A is increased and the gap B is reduced. The construction now makes provision for the magnet yoke 28 to balance out these changes in the gaps A and B precisely.

Figure 3:
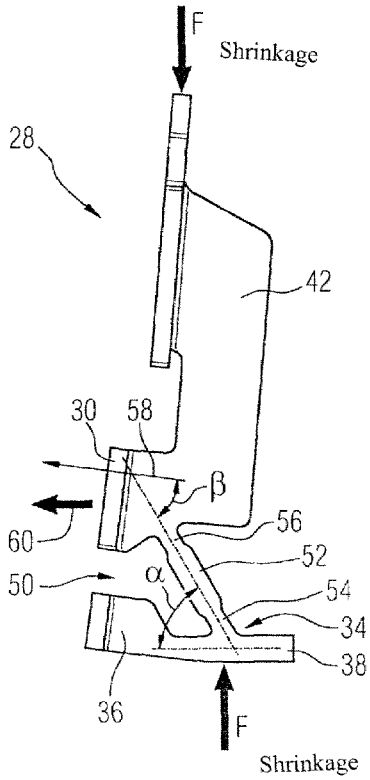
FIG. 3 shows a side view of the magnet yoke used in the line circuit breaker in FIG. 1 and FIG. 2
Figure 4:
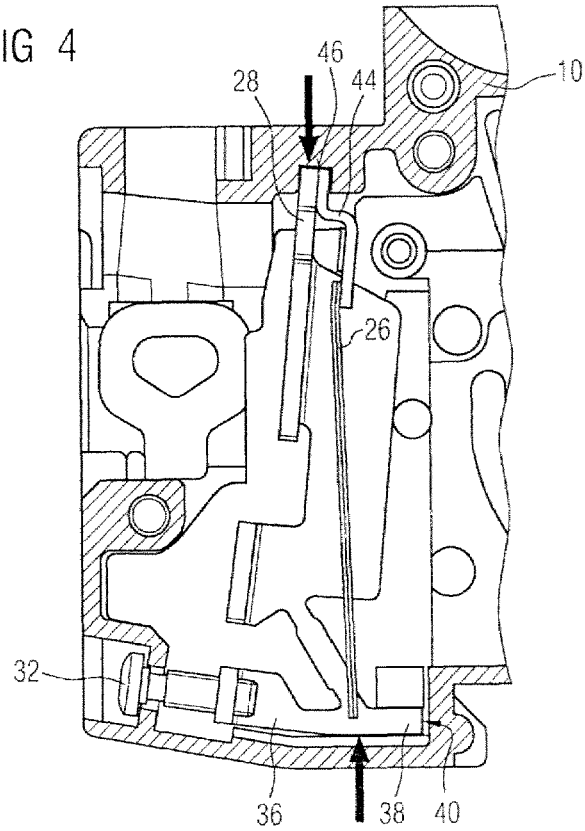
FIG. 4 shows a side view of the magnet yoke in FIG. 3 in the line circuit breaker according to an embodiment, in order thus to explain the effectiveness of the magnet yoke.

The magnet yoke shown as a whole in FIG. 3 has a base body 42, which has the function of guiding magnetic field lines. The magnetic field lines which emerge from the bimetallic element 26 are guided. To fasten the bimetallic element 26, a fastening element 44 (FIG. 4) is used, for which space is available on an upper section 46 of the magnet yoke 28. The upper section 46 functions as a mounting section. As shown in FIG. 4, the mounting section 46 engages in a recess 48 in the housing 10. The foot 34 functions as an opposite mounting section, said foot engaging as mentioned above into the housing in the recess 40.

An elastic element 50 is arranged between the base body 42 and the foot 34. The elastic element 50 consists of a rod 52, which tapers in at the foot 34 at on point 54, which simultaneously forms the lower limb of the T-shape of the foot 34. At the base body 42, the rod-shaped element 52 likewise tapers at one point 56, which is located at approximately the height of the field line outlet plate 30. The tapered points 54 and 56 are used as target bending points. The whole rod 52 is essentially at an angle of $\alpha$ on the foot 34 and at an angle of $\beta$ on a surface normal 58 of the field line outlet plate 30. $\alpha$ and $\beta$ both amount to approximately 45°. This is enabled in that the foot 34 is approximately vertical to the field line outlet plate 30. With the shrinkage of the housing, the forces $F_{shrinkage}$ now act on the mounting sections 34 and/or 46 by way of the brackets 40 or 48. The forces $F_{shrinkage}$ define two directions of the force effect, which are approximately vertical to the surface normal 58. The actual angle deviates slightly from 90°, but moves however within a range of 75° to 105°.

The magnet yoke 28 is now pressed together by the forces $F_{shrinkage}$. The weakest points bend as a result. These are the points 54 and 56. The rod-shaped element 52 thus bends, in the image to the left, so that the base body 42 with the field line outlet plate 30 moves in accordance with the arrow 60. The movement direction according to arrow 60 is almost the same as a direction which is predetermined by the surface normal 58. The movement direction 60 does not deviate from the direction predetermined by the surface normal 58 by more than 20°.

The dimensions of the magnet yoke parts are selected with the magnet yoke 28 such that the afore-mentioned rotational movement of the armature, which is introduced by way of the bracket 40 from the housing 10 during its shrinkage, is counteracted. As mentioned above, the armature 24 moves slightly in the clockwise direction during shrinkage and therewith enlarges the gap A and reduces the gap B. The forces $F_{shrinkage}$ introduced at the same time during the shrinkage allow the movement to be produced in accordance with the case 60. The movement 60 again increases the gap B. The dimensions are to be such that the gap B corresponds again to the gap which is defined in the basic state. The movement 60 once applies to the overall base body 42 and thus also to the upper part 46. The bimetallic element 26 thus also moves in the direction specified by the arrow 60. The enlargement of the gap A is thus also counteracted by the rotation of the armature 24 in the clockwise direction when the housing 10 shrinks.

The construction also expressly takes account of the fact that the armature 24 moves in a shrink-related fashion. The magnet yoke 28 is embodied such that this has no effect however, but instead that the housing shrinkage simultaneously brings about a second effect (on the magnet yoke 28) which counteracts the first effect (on the armature 24). This counter effect is enabled in particular by the provision of the elastic rod-shaped element 52, in particular by the two desired flexion points 54 and 56.

The invention claimed is:

1. A magnet yoke for a line circuit breaker, on which a conductive bimetallic element is arranged and which comprises a base body, which is designed to guide magnet field lines emerging from the bimetallic element during the current flow to a field line outlet plate, by the surface normal of which a first direction is defined and with mounting sections being defined on two opposite sides of the magnet yoke, with which the magnet yoke can be supported in a housing and which allows the introduction of forces from the housing into the magnet yoke in a second and third direction at a predetermined angle to the first direction in each instance, wherein a deformable element is arranged between one of the two mounting sections and the base body, which element deforms with the introduction of forces acting in the second and third direction and as a result allows a movement of the field line outlet plate in a direction, which essentially corresponds to the first direction.

2. The magnet yoke according to claim 1, wherein the deformable element is rod-shaped and has two points with a reduced cross-section which are used as desired flexion points.

3. The magnet yoke according to claim 2, wherein the rod-shaped deformable element extends linearly at an angle of 35° to 55° in respect of the first direction on the one hand and in respect of the second direction on the other hand from a mounting section to the base body.

4. The magnet yoke according to claim 1, wherein one of the two mounting sections is embodied as a T-shaped foot, which allows the engagement of a screw on a limb for defining a position of the foot and thus of the magnet yoke and allows an abutment on another limb in order to hold the foot in the case of different positions of the screw.

5. The magnet yoke to claim 1, wherein the magnet yoke it is embodied as a stamped bending part.

6. A line circuit breaker, comprising a housing, in which a switching device with a switch that can be switched on and off and a combined overcurrent short circuit current tripping device are arranged, with the overcurrent short circuit current tripping device on the one hand including an armature and on the other hand including a magnet yoke, on which a bimetallic element is fastened, by means of which current flows when the switch is switched on, with a field line outlet plate being arranged on the magnet yoke, on which field line outlet plate magnetic field lines emerging from the bimetallic element during current flow and guided by the magnet yoke appear, with the bimetallic element being arranged on one side of the armature in order to press against the armature during overcurrent and also with the field line outlet plate being arranged on an opposite side of the armature in order to magnetically attract the armature during short circuit current so that both during overcurrent and during short circuit current the armature is rotated out of a rotational position at rest in the same predetermined direction, with the rotation potentially causing the switch to be switched off, wherein the housing is subject to shrinkage and the armature is mounted such that during the housing shrinkage, its rotational position at rest changes and the magnet yoke is mounted such that it likewise receives forces during a housing shrinkage and that the magnet yoke is molded such that the received forces effect a change in the position of the bimetallic element and the field line outlet plate such that the change in the rotational position at rest of the armature is counteracted and this is balanced out.

7. The line circuit breaker according to claim 6, wherein the magnet yoke is a magnet yoke on which the conductive bimetallic element is arranged and which comprises a base body, which is designed to guide magnet field lines emerging from the bimetallic element during the current flow to a field line outlet plate, by the surface normal of which a first direction is defined and with mounting sections being defined on two opposite sides of the magnet yoke, with which the magnet yoke can be supported in a housing and which allows the introduction of forces from the housing into the magnet yoke in a second and third direction at a predetermined angle to the first direction in each instance, wherein a deformable element is arranged between one of the two mounting sections and the base body, which element deforms with the introduction of forces acting in the second and third direction and as a result allows a movement of the field line outlet plate in a direction, which essentially corresponds to the first direction.

8. The line circuit breaker according to claim 7, wherein the deformable element is rod-shaped and has two points with a reduced cross-section which are used as desired flexion points.

9. The line circuit breaker according to claim 8, wherein the rod-shaped deformable element extends linearly at an angle of 35° to 55° in respect of the first direction on the one hand and in respect of the second direction on the other hand from a mounting section to the base body.

10. The line circuit breaker according to claim 7, wherein one of the two mounting sections is embodied as a T-shaped foot, which allows the engagement of a screw on a limb for defining a position of the foot and thus of the magnet yoke and allows an abutment on another limb in order to hold the foot in the case of different positions of the screw.

11. The line circuit breaker according to claim 7, wherein the magnet yoke is embodied as a stamped bending part.

* * * * *